US012773590B2

(12) United States Patent
Heath

(10) Patent No.: US 12,773,590 B2
(45) Date of Patent: Oct. 27, 2026

(54) QUICK CONNECT CHAIN TENSIONER FOR BICYCLES AND BICYCLE TRAINERS

(71) Applicant: Zwift, Inc., Long Beach, CA (US)

(72) Inventor: Jonathan Heath, London (GB)

(73) Assignee: Zwift, Inc., Long Beach, CA (US)

( * ) Notice: Subject to any disclaimer, the term of this patent is extended or adjusted under 35 U.S.C. 154(b) by 74 days.

(21) Appl. No.: 19/034,884

(22) Filed: Jan. 23, 2025

(65) Prior Publication Data

US 2025/0235731 A1 Jul. 24, 2025

Related U.S. Application Data

(60) Provisional application No. 63/624,021, filed on Jan. 23, 2024.

(51) Int. Cl.
*A63B 21/018* (2006.01)
*A63B 22/06* (2006.01)

(52) U.S. Cl.
CPC ..... *A63B 21/018* (2013.01); *A63B 22/0605* (2013.01)

(58) Field of Classification Search
CPC ..... A63B 21/018; A63B 22/0605; A63B 21/00076; A63B 21/023; B62M 9/16
See application file for complete search history.

(56) References Cited

U.S. PATENT DOCUMENTS

| | | | | |
|---|---|---|---|---|
| 4,637,808 | A * | 1/1987 | Nakamura | B62M 9/126 474/80 |
| 4,925,183 | A * | 5/1990 | Kim | A63B 69/16 482/61 |
| 6,068,279 | A * | 5/2000 | Dion | B62M 23/00 280/230 |
| 6,945,917 | B1 * | 9/2005 | Baatz | A63B 21/0051 482/57 |
| 11,981,399 | B1 * | 5/2024 | Lin | B62M 25/04 |
| 2015/0251725 | A1 * | 9/2015 | Rockwood | F16H 9/24 474/56 |
| 2022/0144381 | A1 * | 5/2022 | Rodriguez | B62K 19/30 |
| 2022/0355900 | A1 * | 11/2022 | Shipman | B62M 9/121 |
| 2024/0399233 | A1 * | 12/2024 | Simmonds | A63B 69/16 |

* cited by examiner

*Primary Examiner* — Sundhara M Ganesan
(74) *Attorney, Agent, or Firm* — SoCal IP Law Group LLP; Jonathan Pearce

(57) ABSTRACT

There is disclosed a chain tensioner system including a pulley for rotatably engaging a bicycle chain or belt, a pulley arm, upon which the pulley is mounted, the pulley arm movable between a closed position and an open position, a fixed tensioner arm, engaged with the pulley arm, and a tensioner element for connecting the fixed tensioner arm with the pulley arm, the tensioner element for keeping the pulley arm in either the closed position or the open position under tension provided by the tensioner element when the pulley arm is in either the closed position or the open position.

22 Claims, 11 Drawing Sheets

FIG. 1
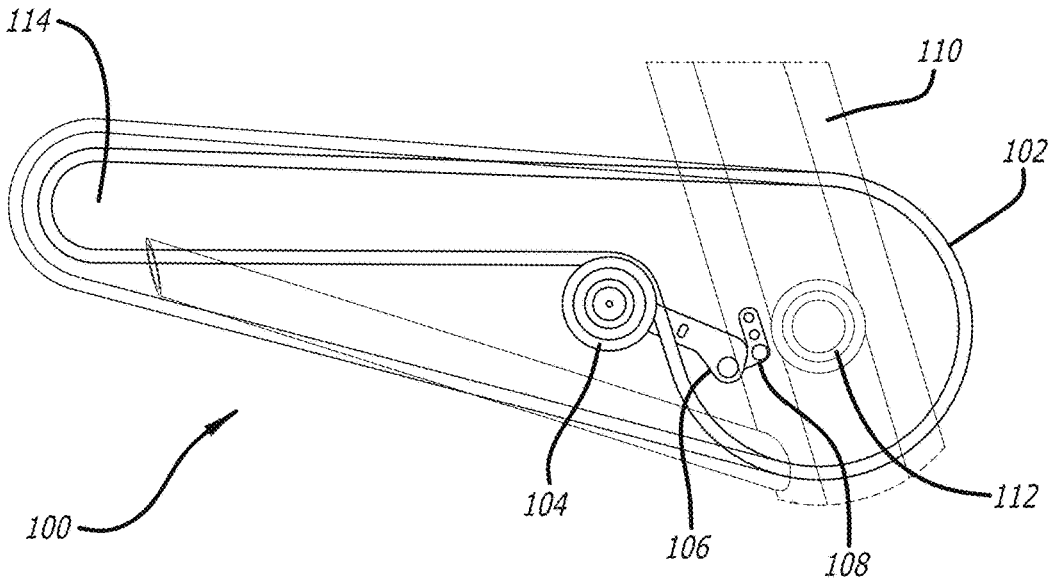
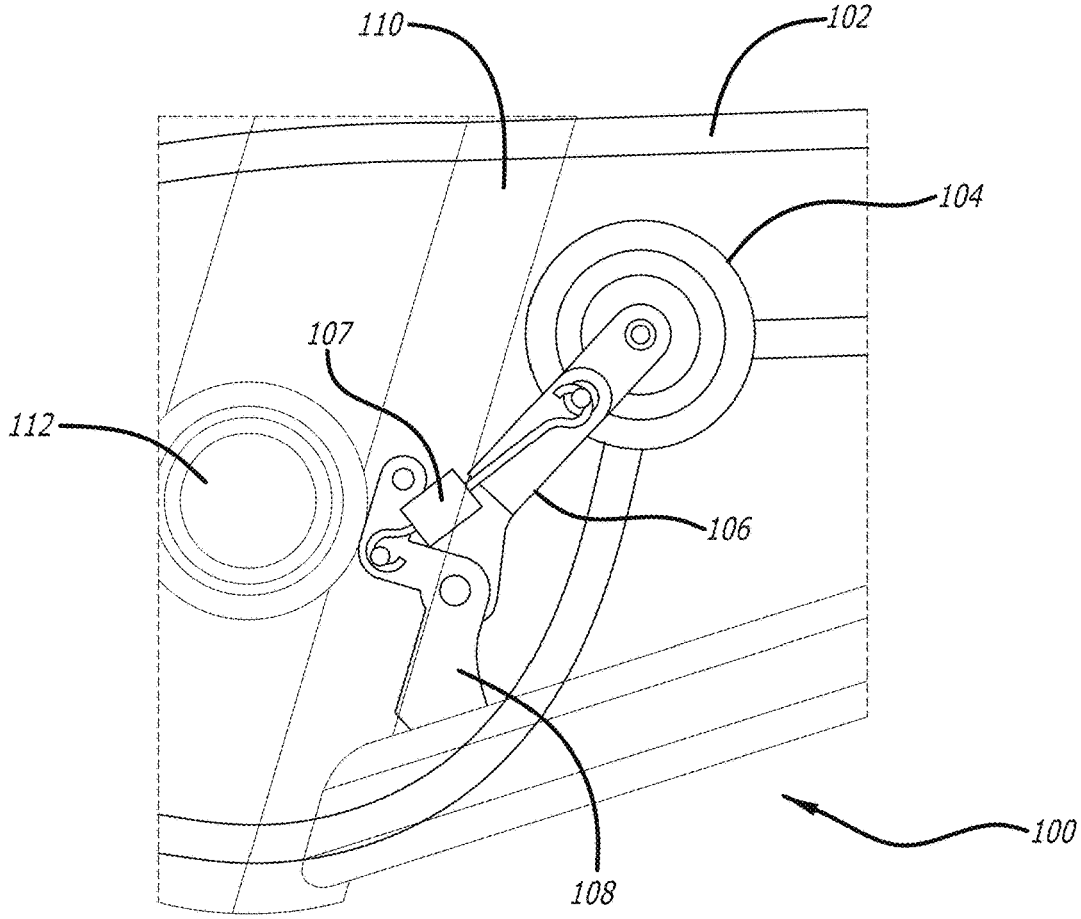
FIG. 2

FIG. 10
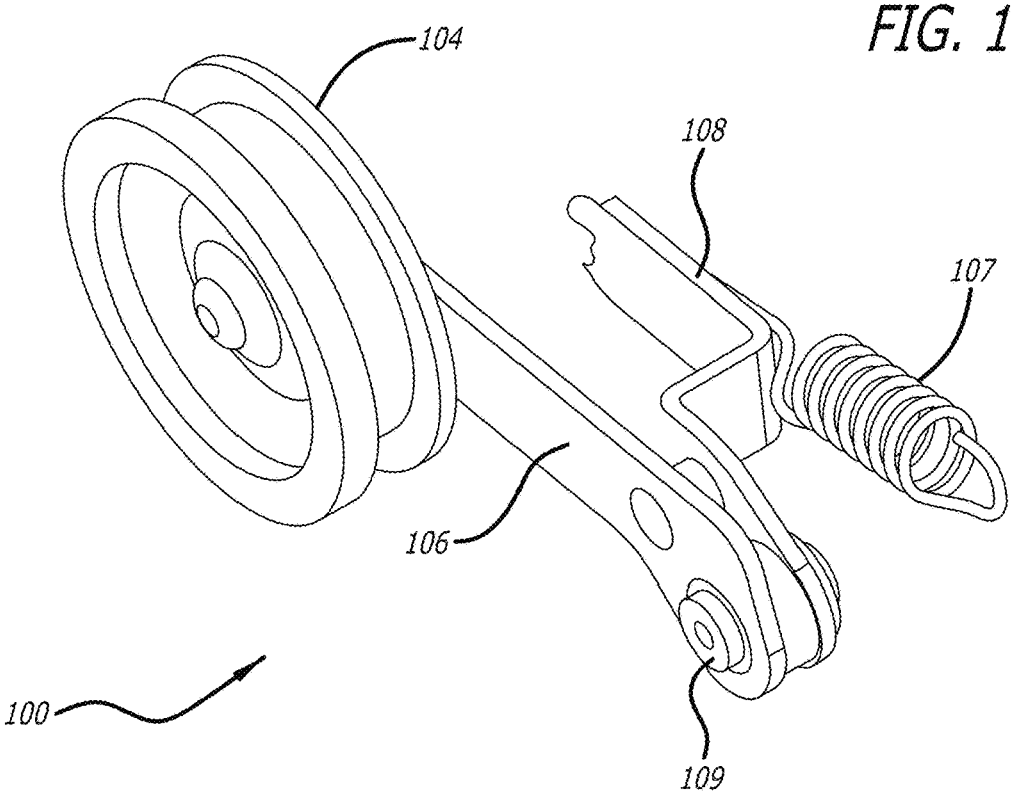
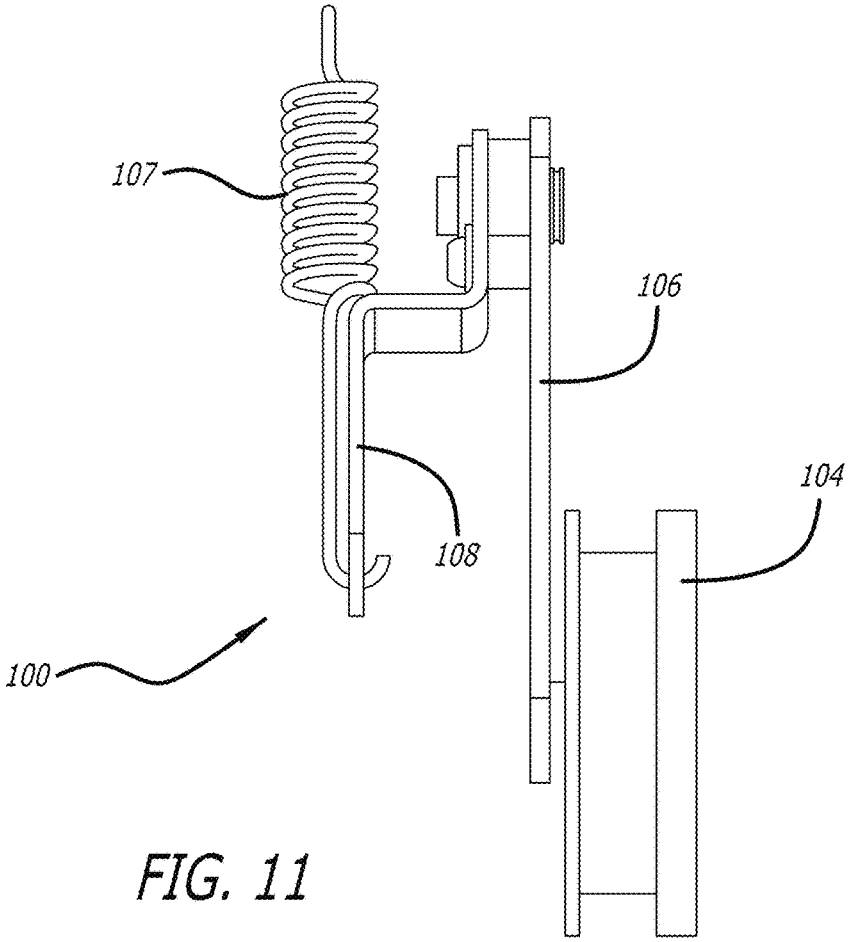
FIG. 11

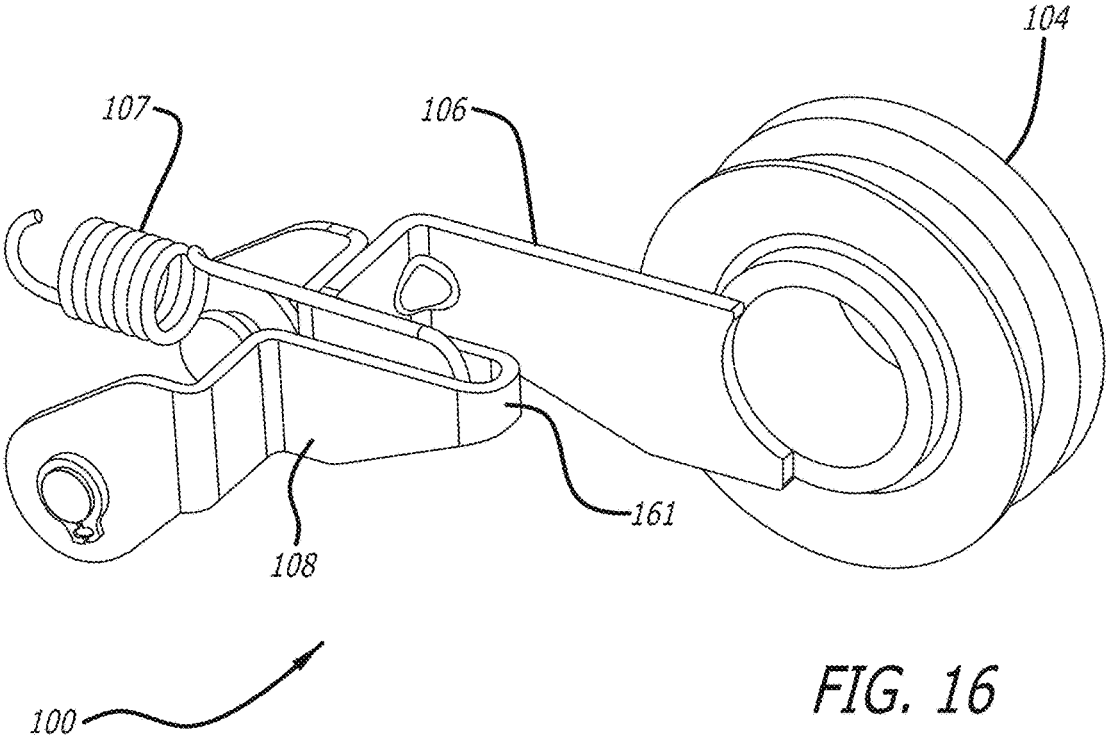
FIG. 16
FIG. 17
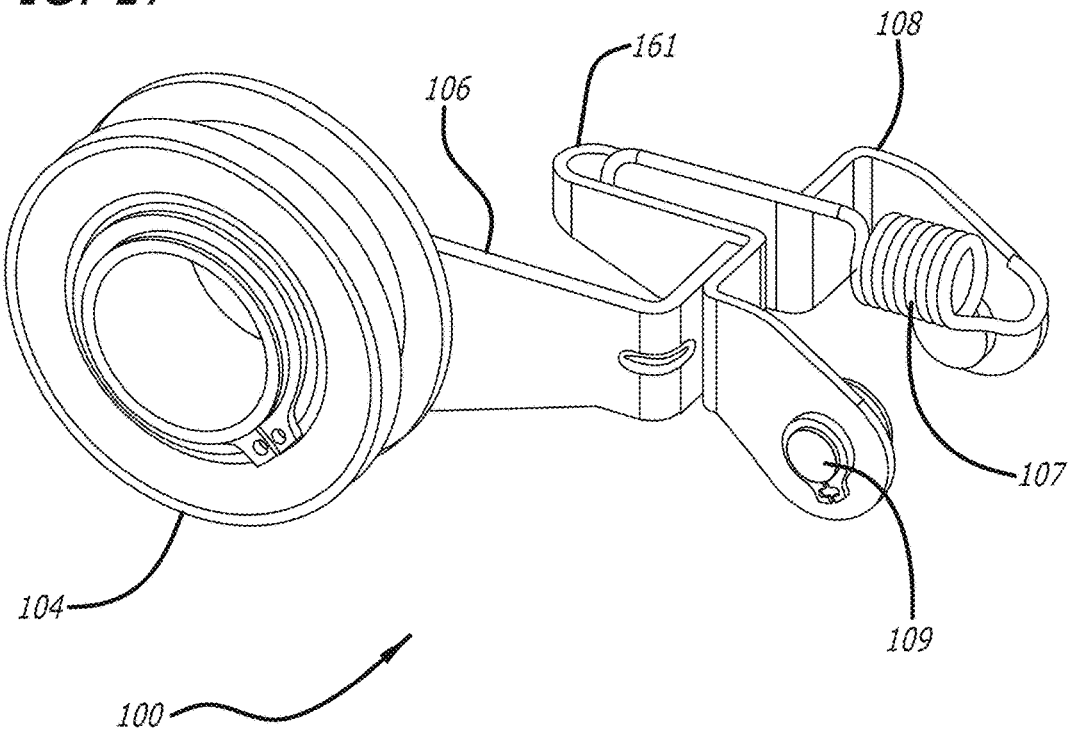

QUICK CONNECT CHAIN TENSIONER FOR BICYCLES AND BICYCLE TRAINERS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from European Patent Application No.: 25153511.8 filed Jan. 23, 2025 entitled "QUICK CONNECT CHAIN TENSIONER FOR BICYCLES AND BICYCLE TRAINERS" and U.S. provisional patent application Ser. No. 63/624,021 filed Jan. 23, 2024 (which is incorporated herein by reference in its entirety) and entitled "QUICK CONNECT CHAIN TENSIONER FOR BICYCLES AND BICYCLE TRAINERS."

BACKGROUND

Field

This disclosure relates to exercise devices such as stationary bicycles and bicycle trainers and, more particularly, to a quick connect chain tensioner for cycling exercise devices and bicycle trainers.

Description of the Related Art

There exist various types of exercise devices, many of which provide resistance to increase the intensity of the exercise. For example, dedicated indoor cycles and road cycles fixed to training devices (so-called "trainers") enable a user to control or implement systems whereby resistance is added to the pedals by any number of methods to train the user to achieve an increase in endurance, power, and speed.

Some systems rely upon manual addition of resistance through gearing, the application of a fixed brake, or even wind-based resistance (e.g., blower-style flywheels on wheels of old-style exercise cycles). More complex systems began enabling computer control of electronic resistance devices in the 1980s and 1990s. These systems typically enabled users to ride through pre-programmed courses of simulated hills and flats and valleys with the associated increases and decreases in resistance controlled by a computer controller. Modern users can virtually experience these changes in terrain via a display that appears to show the user navigating through a particular virtual or real-world course.

These electronic controlled resistance devices are typically magnetic combined with a small or sometimes large flywheel. The most realistic feeling trainers and bicycles typically utilize large flywheels to simulate the mass of the rider and bike. Even more modern resistance devices rely almost exclusively on carefully controlled electromagnets. They do spin, so in some sense they can act as flywheels, but virtually all of the added resistance and momentum is simulated by software through electromagnetic application of current on the spinning axle. These systems are sufficiently sophisticated that they can simulate abrupt changes in gearing typical of road bicycles with many-geared cassettes using a single gear.

A bicycle trainer is a piece of equipment that enables a user to ride a bicycle while the bicycle remains stationary, for example, inside when riding conditions outside are not favorable. Direct drive smart bicycle trainers require a user to remove the rear wheel of the bicycle and place the bicycle on the trainer. A direct drive trainer typically includes a frame, a device to hold the connected bicycle (or bicycle frame) securely, and a mechanism that provides resistance when the pedals are turned, such as a flywheel or an electromagnetic resistance system. The direct drive trainer acts as a replacement for the rear wheel, and is used with a matching cassette, so that the user can shift gears during the simulated ride. This creates a potential barrier to users wishing to begin the process of using the trainer in the process of mounting the bicycle or bicycle frame. Specifically, the process of mounting the bicycle or bicycle frame to the trainer can require users to wrestle with or otherwise manage a chain tensioner that holds the chain tightly around the axle and the cassette for the bicycle.

Traditional bicycles use cassettes that incorporate a plurality of gears. Seven, eight, ten and twelve gears on a cassette are common, but other configurations are also used. Derailleur systems used with these cassettes typically incorporate chain tensioners to ensure that any slack in a chain (required to enable the chain to move from a low gearing to a high gearing which are quite different in diameter) is taken up and the teeth of the cassette gears remain engaged with the chain. Some system to maintain tension in the chain is necessary because as the gearing changes, the amount of the chain used by the gear changes as well. However, these chain tensioners are designed to always function and exert a tension force against the chain to keep it in place. This makes sense because bicycles operate on roadways, hit bumps, are jostled, or are otherwise moved about and a rider generally has no desire to unexpectedly lose tension in a chain and thereby lose the ability to gain speed by pedaling because the chain tensioner unexpectedly moved to a position where it stopped acting as a tensioner. But, as a result, these chain tensioners can be difficult to work with, and cumbersome to remove because they are always fighting against being moved with their tension.

Chains and cassettes are typically changed rarely on road bikes. So, it is more imperative to ensure continuous chain tension than it is to enable easy removal of a cassette or wheel, or the crank of a bicycle meant for the roadway.

In contrast, a bicycle or bicycle frame mounted on a trainer, and intended for indoor use would benefit from a chain tensioner able to easily take up slack on a chain (particularly when used with a single-sprocket system envisioned by the inventor of this patent, discussed below) while also enabling the bicycle or bicycle frame to be added to or removed from the trainer. Therefore, it would be beneficial to have a chain tensioner that retains its position providing chain tension, but also enables easy removal of that tension and remains fixed without tension to provide a user the opportunity to mount or un-mount a bicycle or bicycle frame to a bicycle trainer. Although particularly useful in the case of a single sprocket system, such a tensioner is also useful in the case of a traditional cassette-based system.

U.S. patent application Ser. No. 18/084,809 filed Dec. 20, 2022, by the assignee of the present patent and the entirety of which is incorporated herein by reference, discloses one such single sprocket system. Another application disclosing a similar, adjustable single sprocket system, also incorporated by reference, was filed under U.S. patent application Ser. No. 18/976,899 on Dec. 11, 2024. One of the primary benefits of a single sprocket is ease of use from the perspective of a consumer. Unlike a typical cassette, the user need only wind the chain around a single gear (e.g. single sprocket). The user need not engage with or use a derailleur system and the user need not select a particular or preferred cassette with the associated selection of a number of gears for use with the cassette. The single sprocket—mounted to the bicycle trainer—may operate to simulate "virtual gears" using software controlling the associated trainer.

U.S. patent application Ser. No. 18/976,899 filed Dec. 11, 2024, by the assignee of the present patent and the entirety of which is incorporated herein by reference discloses a variation on the application umber Ser. No. 18/084,809 above which provides for an adjustable single-sprocket system in which tiny adjustments may be made to the single sprocket when not in use to enable it to move freely without chain interference or needless noise. This system may likewise be used with the chain tensioner disclosed herein.

DESCRIPTION OF THE DRAWINGS

FIG. 1 is an example of a chain tensioner and bicycle chain system.

FIG. 2 is a close-up of a chain tensioner system in a pre-load state.

FIG. 10 is a perspective view of an alternative configuration of a chain tensioner system.

FIG. 11 is a top view of an alternative configuration of a chain tensioner system.

FIG. 16 is a top, front, perspective view of an alternative configuration of a chain tensioner system.

FIG. 17 is a top, back, perspective view of an alternative configuration of a chain tensioner system.

Figure 3:
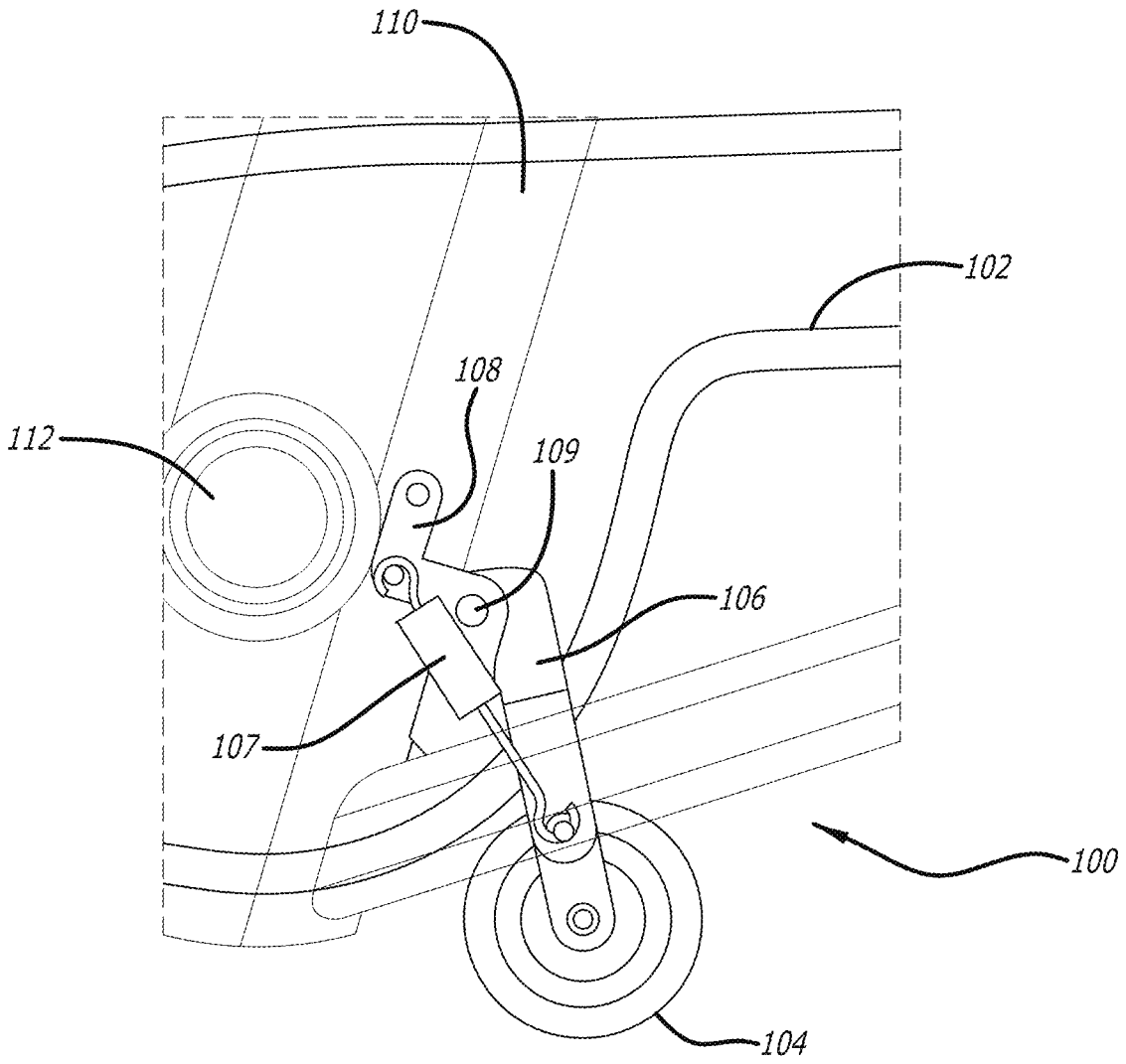
FIG. 3 is a close-up of a chain tensioner system in an assembly state.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

FIG. 1 is an example of a chain tensioner system 100. The chain tensioner system 100 that may be easily released of tension to enable quick connection to and removal from a bicycle, trainer, or indoor cycle 110 may rely upon a hinge-like motion. The tension provided by such a chain tensioner is seen in FIG. 1.

The chain tensioner pulley 104 takes up the slack in the bicycle chain 102 or belt that would otherwise be present. The slack is needed for installation of the chain 102 around the crank 112 (gearing not shown) and any gears (or a single gear) 114. But, once the chain 102 is engaged with the crank 112 and gears, the slack is no longer needed, and the chain tensioner pulley 104 should be put in place to take up that slack. The position of the crank 112 is shown above on the right side) while the position of the gear(s) 114 is shown on the left side. Without the tensioner 104, the chain 102 would be slack and would not adequately engage the gears of crank 112 or the gear(s) 114 or both and the cycling experience or trainer-based exercise experience would be poor.

Also present in this system are the tensioner arm 106 and a pulley arm 108 which act as a mount and actuator for the tension provided by the overall chain tensioner system 100. The indoor cycle 110 frame is visible as a mount point for the crank 112.

The various states of the chain tensioner system 100 may be seen in FIGS. 2-5, each described in turn below. FIG. 2 is a close-up of a chain tensioner system 100 in a pre-load state. At an initial stage, the chain tensioner pulley 104 is shown in a "closed" position. However, the chain 102 is not yet looped through the associated pulley (see FIG. 7) on the chain tensioner pulley 104. The other elements are present as well including the indoor cycle 110, a spring 107 that provides the tension, the tensioner arm 104, the pulley arm 108, along with the crank 112.

Figure 5:
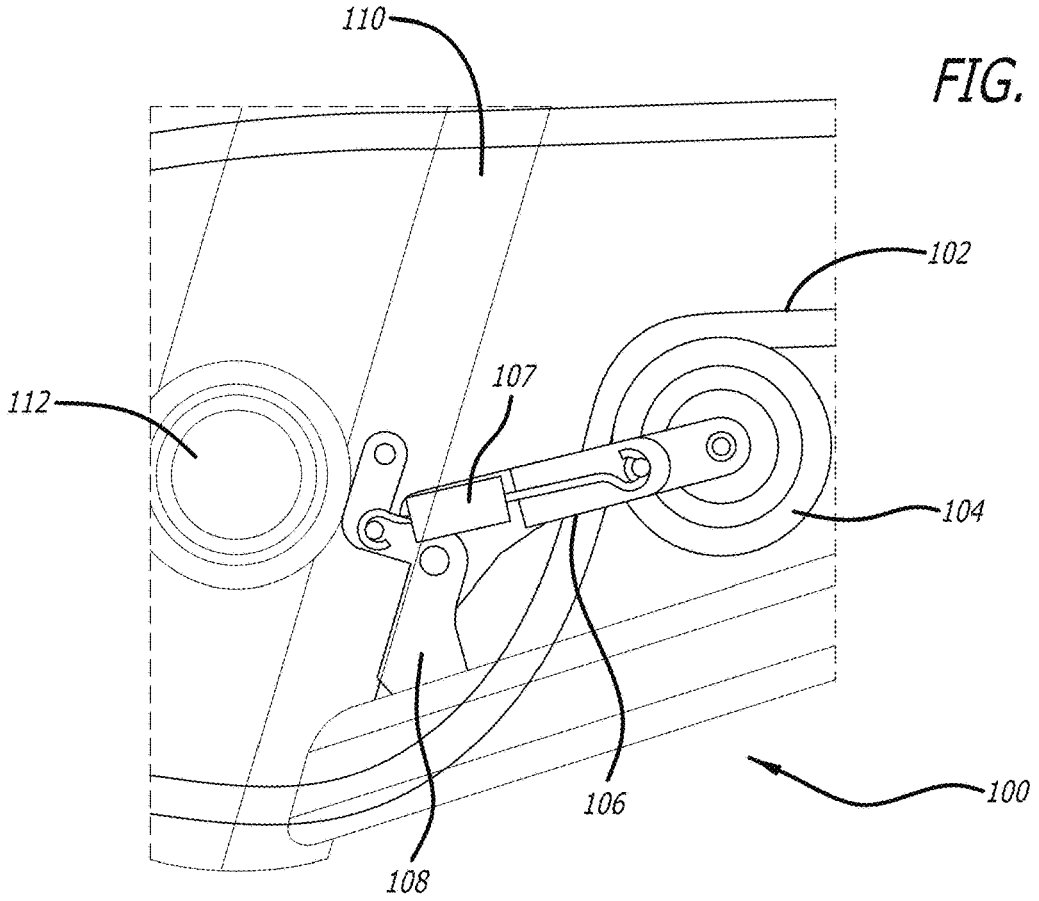
FIG. 5 is a close-up of a chain tensioner system in a working state.

FIG. 3 is a close-up of a chain tensioner system 100 in an assembly state. To enable the chain 102 to be slotted into the pulley 104, and to be engaged with the crank 112 and the gear(s) (not shown in this figure), the pulley arm 106 may be pushed downward, against the tension provided by the tensioner element (in this case a spring 107) to provide room to thread the chain 102 through a groove designed to surround the chain 102 on three sides within the chain tensioner pulley 104. The chain tensioner pulley 104 is mounted at one end of the pulley arm 106 and there is a pivot point 109 at the other end of the pulley arm 106. The pivot point 109 is where the pulley arm 106 is mounted to the indoor cycle 110 frame (see FIGS. 12-17 below) and/or a tensioner arm 108 (shown here) and can pivot between a resting or storage position (FIG. 3) and a tensioning position (FIG. 5, below).

The tensioner element (e.g. the spring 107) is mounted to a point just at or near the pulley 104 itself on the pulley arm 106 (e.g., in the vicinity of the point where the pulley 104 is mounted on the pulley arm 106) and to a point on the bicycle frame (See FIGS. 12-17 below), or a portion of the tensioner arm 108. In this way, a hinge point is created (here, at pivot point 109) that holds tension when the chain tensioner pulley 104 is either an open or a closed position. The position shown above (FIG. 3) is "open" while the position shown in the figure above this figure (FIG. 5, below) is "closed." The spring 107 operates in conjunction with the pivot point 109 or hinge point to pull the chain tensioner pulley 104 toward the indoor cycle 110 frame or the mount point for the spring 107 and to ensure that the over center position is not maintained (see FIG. 4, below). In short, the pivot point acts as an either/or situation where the chain tensioner pulley 104 will either be open (disengaged) or closed (providing tension), but will move toward either rather than remain in an overcenter state (FIG. 4, discussed below).

Figure 4:
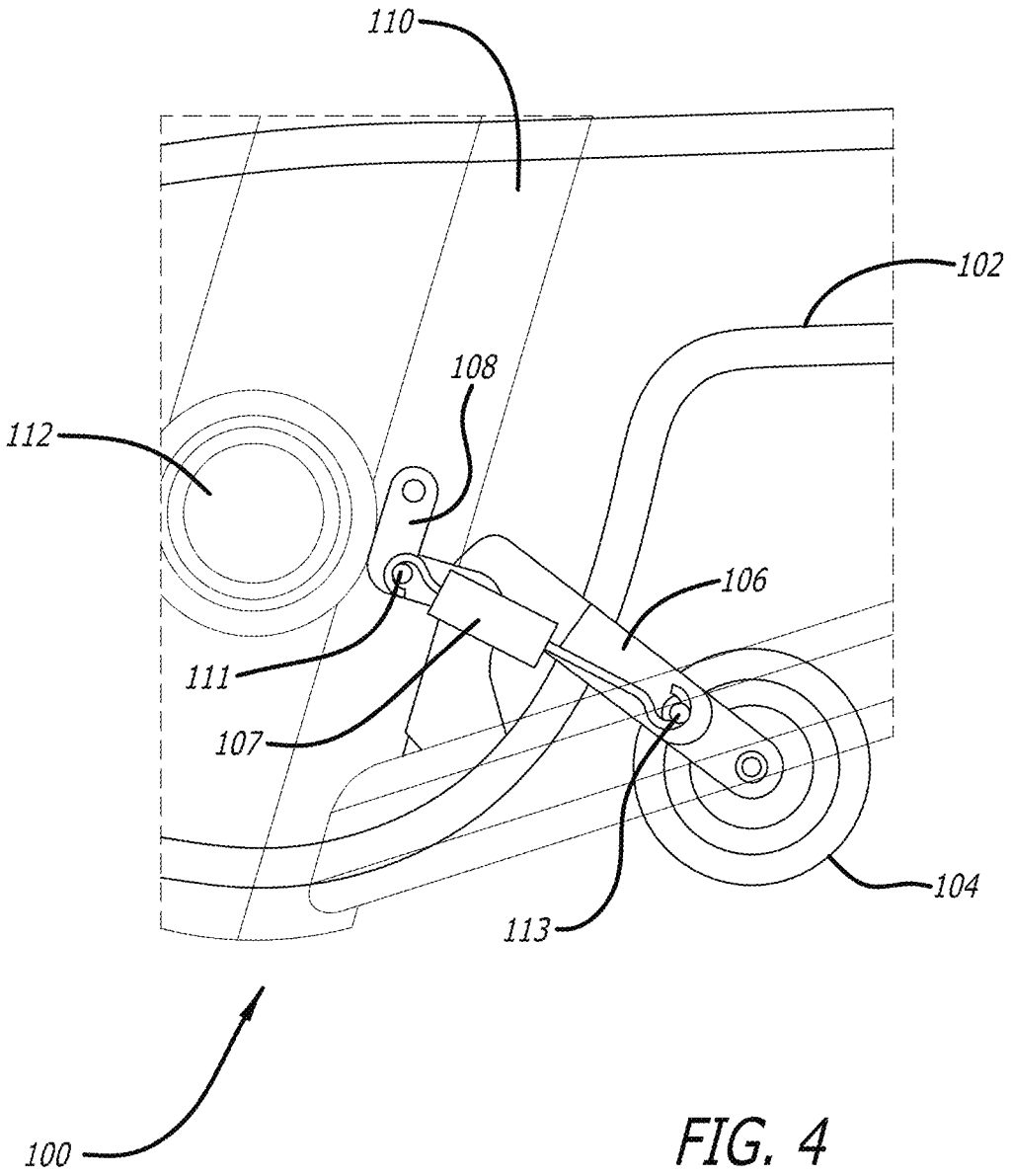
FIG. 4 is a close-up of a chain tensioner system in an overcenter state.

FIG. 4 is a close-up of a chain tensioner system 100 in an overcenter state. This image shows an intermediate position between the open and closed position. The position where the pivot point (hidden behind spring 107 in this FIG.) and the points 111, 113 where the spring 107 is affixed are aligned will be referred herein as the "over center position", "mid-point" or "mid-point position". The chain tensioner pulley 104 will resist remaining in this position as the spring 107 is at its greatest extension. The chain tensioner pulley 104 will prefer being fully in the open or closed position. Here, no tension is being provided to the chain 102.

The same pulley arm 106, tensioner arm 108, indoor cycle 110, and crank 112 are also present.

FIG. 5 is a close-up of a chain tensioner system 100 in a working state. Here, the chain tensioner pulley 105 is shown in a position for operation. The chain tensioner pulley 104 has been opened (FIG. 4), the chain 112 has been threaded into the pulley 104 at the end of the pulley arm 106, and the chain tensioner pulley 104 has been returned to the closed position. The weight of the chain 102 and action of movement of the chain 112 through the pulley 104 may exert some downward force on the pulley arm 106, but the spring 107 is designed so as to provide sufficient counter-acting force to ensure that the chain tensioner pulley 104 remains in the closed position unless acted upon by an outside force (e.g. a human, pushing the chain tensioner pulley 104 downward to an open position). Relatively minor engagement with the chain tensioner pulley 104 will be insufficient to move it upward or downward past the center point due to the orientation and configuration of the various components of the chain tensioner system 100. This is to avoid the chain tensioner pulley 104 unexpectedly moving from a tensioning or working position to an open position.

The tensioner arm 108 is shown mounted within or on the frame of the indoor cycle 110. The tensioner arm 108 or the mount point or both may be an integral part of a bicycle frame or a trainer frame or may be mounted thereto by a bolt or rivet. Or, a portion of the bicycle frame may be modified to accept connection to or engagement with the spring 107 or the tensioner arm 108 or both.

Figure 6:
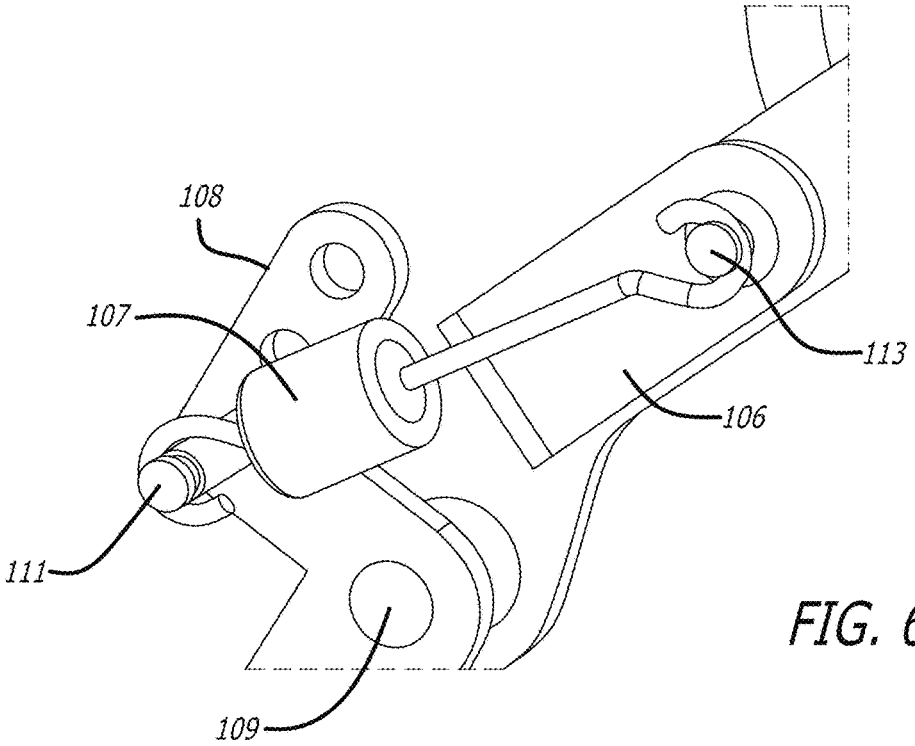
FIG. 6 is a closeup of the tensioner arm and tensioner spring.

FIG. 6 is a closeup of the tensioner arm 108 and tensioner spring 107. Here, the pivot point 109 may be seen as "behind" the pulley arm 106 tensioner mount point 113. Or, said another way, when the pulley arm 108 is in the overcenter position (where the pivot point and the two points where the tensioner element is affixed are aligned), the pivot point 109 is between the two points 111, 113 where the spring 107 is affixed. This causes the preference for the pulley arm 106 to be in either the closed or the open position, but not in between those two positions.

Figure 7:
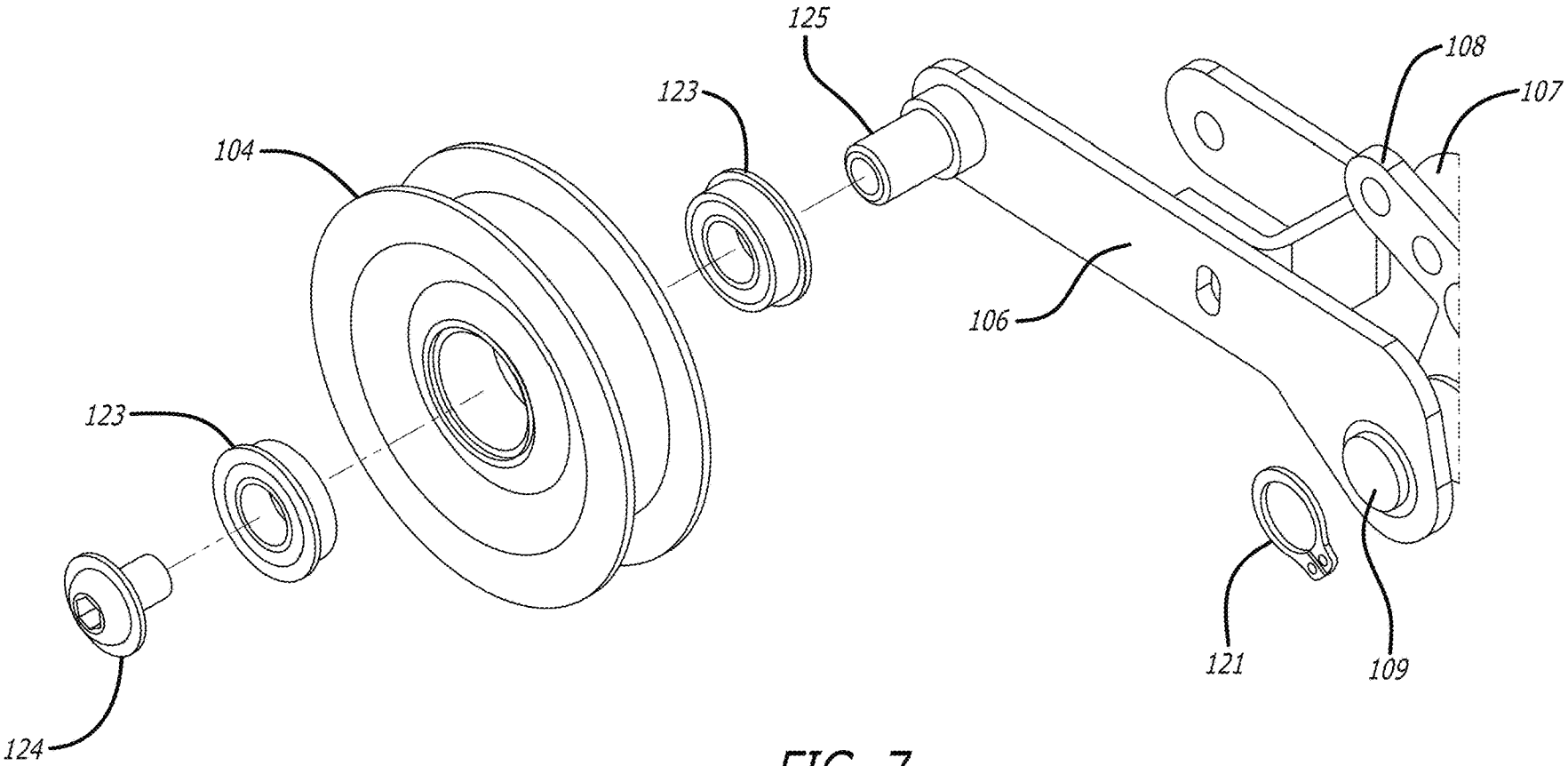
FIG. 7 is a close-up and partially exploded view of the pulley arm and pulley.

FIG. 7 is a close-up and partially exploded view of the pulley arm 106 and chain tensioner pulley 104 showing individual components. Here, from an opposite perspective of FIG. 6, the pulley arm 106 and the tensioner arm 108 may be seen. The spring 107 is just barely visible on the far right. And, the opposite side of the pivot point 109 of the pulley arm 106 is shown with a compression lock 121 to secure the pulley arm 106 in place, engaged with the pivot point 109. The pulley 107 is shown as lacking in gears corresponding to a typical bicycle chain, and that may be preferrable. In some cases, the pulley 104 may have gearing to match typical bicycle gearing. Multiple ball bearings 123 are shown as well as a hexagonal (Allen) nut 124 to secure the pulley 104 to the pulley bushing 125 on the pulley arm 106. The pulley 104 may be mounted to the pulley arm 106 in any other manner where the pulley 104 can rotate about an axis, for example an axis perpendicular to the pulley arm 106.

The inventors herein have determined that, with the proposed configuration of this example, a tensioner element having 15 newtons of initial tension force when in either the closed or open position will have approximately 61.4 newtons of force in the working position (position [2] above). The resulting load being applied to the chain engaged with the pulley when in the closed position is approximately 1.25 kilograms. Likewise, the force FY (see FIG. 9 below) to be applied to move the pulley 104 away from the closed position will have to be at least 12.5 newtons.

Figure 8:
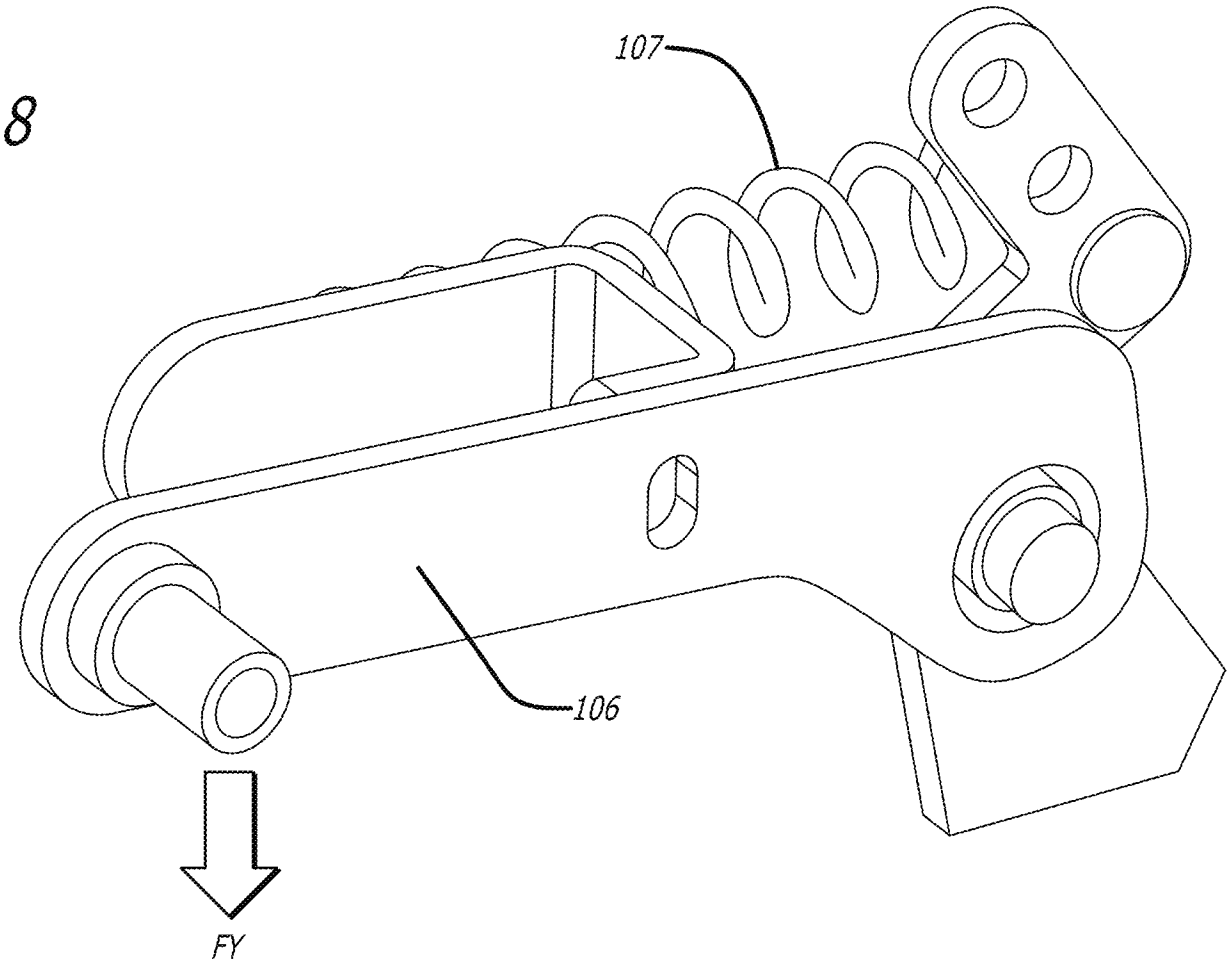
FIG. 8 is a perspective view of the pulley arm and pulley under tension near an overcenter state.

FIG. 8 is a perspective view of the pulley arm 106 and pulley (not shown in this figure) under tension near an overcenter state. When moving to the overcenter position (mid-point position) in the proposed configuration, the spring 107 extension distance increases from 7.5 millimeters in the working position (position [2] above) to 14 millimeters, and the load becomes 102 newtons. In this example, the force necessary to overcome the over center position is about 13.5 newtons or 1.3 kilograms. In other words, in this example, the maximum value for force FY that the user will have to apply to move the pulley arm as the pulley arm rotates between the closed position will be about 13.5 newtons, when reaching the overcenter (or midpoint) position.

These proposed numbers are merely the case with the design proposed and may be any suitable numbers so long as the spring load in the over center position exceeds the load applied by the open or closed position pulley arm/spring combination. The exact numbers may vary dependent upon the configuration of the elements, lengths of the pulley arm, the tensioner arm, and the spring. The user experience is better if the load allows the system to maintain the engagement in the closed position while still allowing the user to relatively easily move the chain tensioner system between the open and closed positions. Otherwise, some sufficient strength may be required to engage and disengage the chain tensioner, making it inaccessible to individuals with insufficient strength to open the chain tensioner system. Likewise, too much force on the chain will inadvertently increase friction and resistance on the chain's movement. It is preferable that tension should be sufficiently maintained, but only lightly.

Alternative embodiments of the various components, arm lengths, spring strength, and the like are possible as well. For example, another suitable set of measurements are presented in the chart below.

| | Values in Appendix A | Alternative Maximum Range | Alternative Preferred Range | Alternative Preferred Value |
|---|---|---|---|---|
| Initial Spring Load | 15N<br>26N | 70-100N | 85-95N | 90N |
| Spring Constant | 6.2 N/mm<br>9.0 N/mm | 8-12 N/mm | 8-13 N/mm | 10.5 N/mm |
| Load to Move Pulley to Over-Centre Position | 13.5N (1.3 kg) | 12-25N | 16-20N | 18N |

Figure 9:
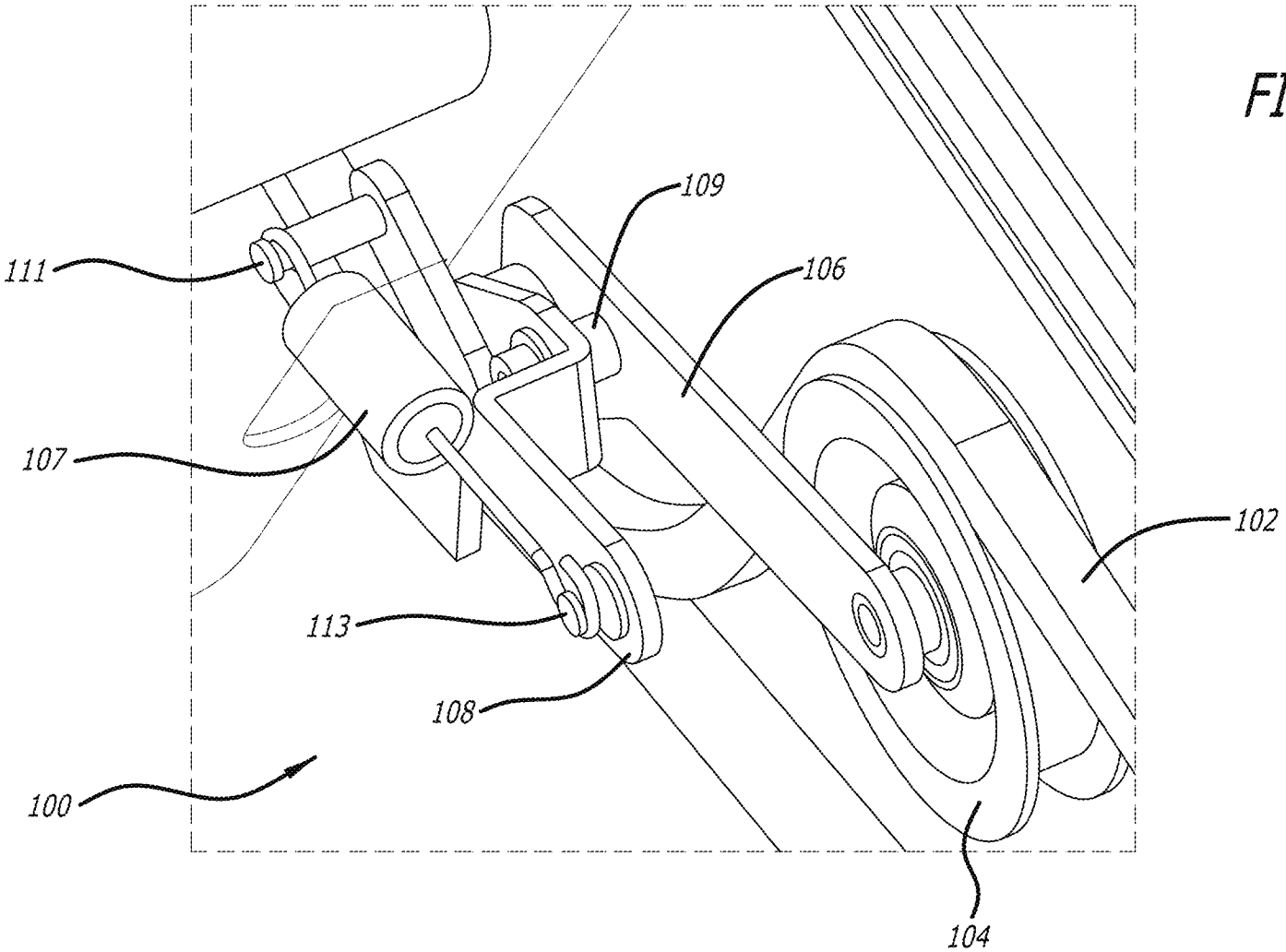
FIG. 9 is a top, perspective view of a chain tensioner system engaged and in the working state.

FIG. 9 is a top, perspective view of a chain tensioner system 100 engaged and in the working state. Here, the chain 102 may be seen engaged with the chain tensioner pulley 104, which is held by the pulley arm 106, which is joined at the pivot point 109 to the tensioner arm 108. The tension is provided by the spring 107 mounted at mount points 111, 113 to the tensioner arm 108 and pulley arm 106, respectively.

FIGS. 10 and 11 are a perspective and a top view of an alternative configuration of a chain tensioner system 100. Here, the tensioner arm 108 and pulley arm 106 share a single mount point, which may be on or within a frame of a bicycle, trainer, or indoor cycle for simplified attachment to a bicycle, trainer, or indoor cycle. This configuration also assumes that the opposite end of the tensioner element will be affixed to a point on the bicycle frame or trainer. The attachment point (see FIGS. 12 and 13, below) may enclose or encompass the pivot point 109. Here, the tensioner arm 108 is shorter than the pulley arm 106. Because the mount point is integral or within the bicycle frame or indoor cycle frame, this alternative configuration is simpler and easier to manufacture than the chain tensioner system shown with respect to FIGS. 1-9.

Figure 12:
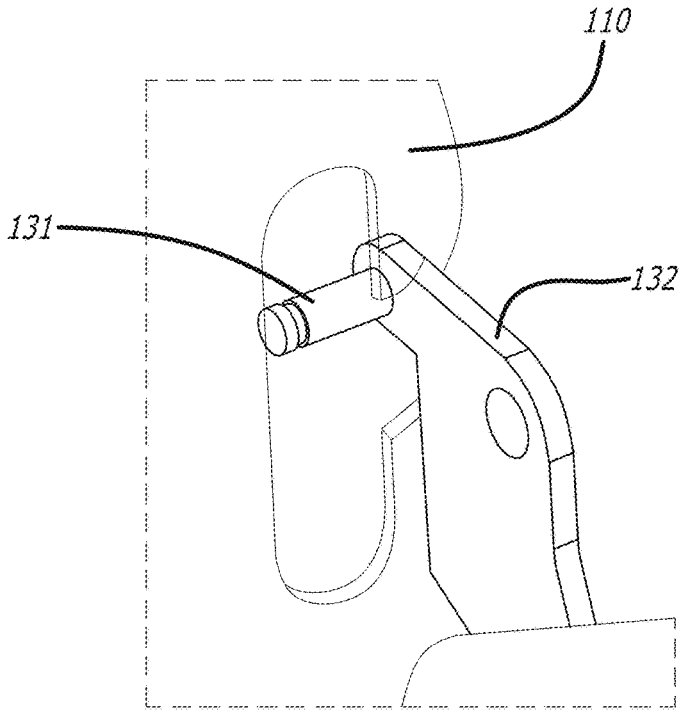
FIG. 12 is a close-up view of an attachment point for an alternative configuration of a chain tensioner system showing a bicycle or trainer frame cutout.

FIG. 12 is a close-up view of an attachment point for an alternative configuration of a chain tensioner system 100 showing a bicycle or trainer frame cutout. This configuration may relay upon a bolt or a pin 131 in or through the indoor cycle 110 frame. The pin my engage with the spring 107 (see FIGS. 10-11) and simultaneously may hold the tensioner arm 108 or the mount 132 to which the tensioner arm 108 engages to the indoor cycle 110 frame.

Figure 13:
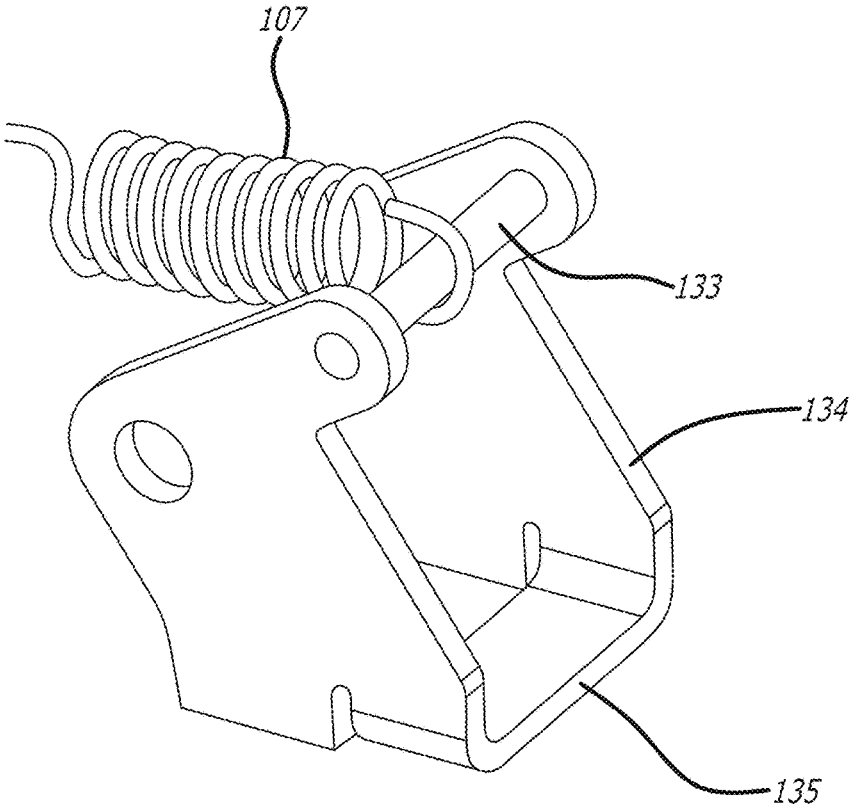
FIG. 13 a close-up view of a different type of attachment point for an alternative configuration of a chain tensioner system.

FIG. 13 a close-up view of a different type of attachment point for an alternative configuration of a chain tensioner system 100 (see FIGS. 10-11). This configuration relies upon a closed, dual-sided mount 134 that includes a pin 133 for engaging with the spring 107. A slide-on mount point 135 for mounting the attachment point to a frame of a bicycle, indoor cycle, or trainer. Because this mount point 135 is integrated, the frame of the device to which it mounted need not be cut or include a cut-out. Instead, a small tab may be included to which the attachment point may be affixed and held in place by tension and/or a bolt or pin.

Figure 14:
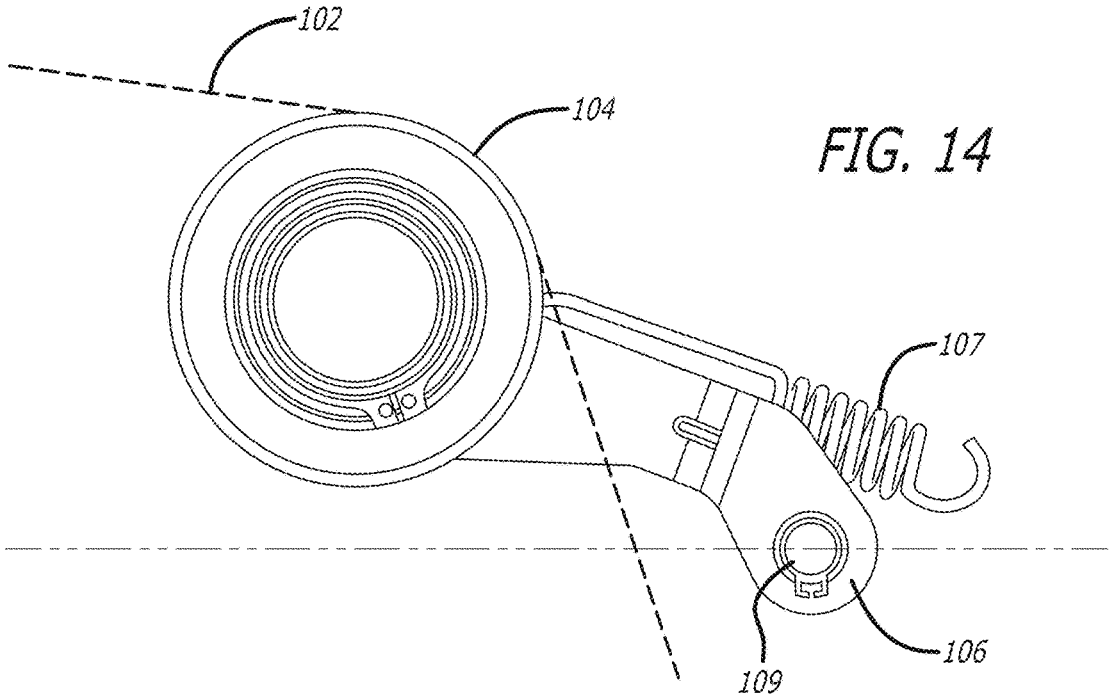
FIG. 14 is a side view of a chain tensioner system in a working state showing the pivot point.
Figure 15:
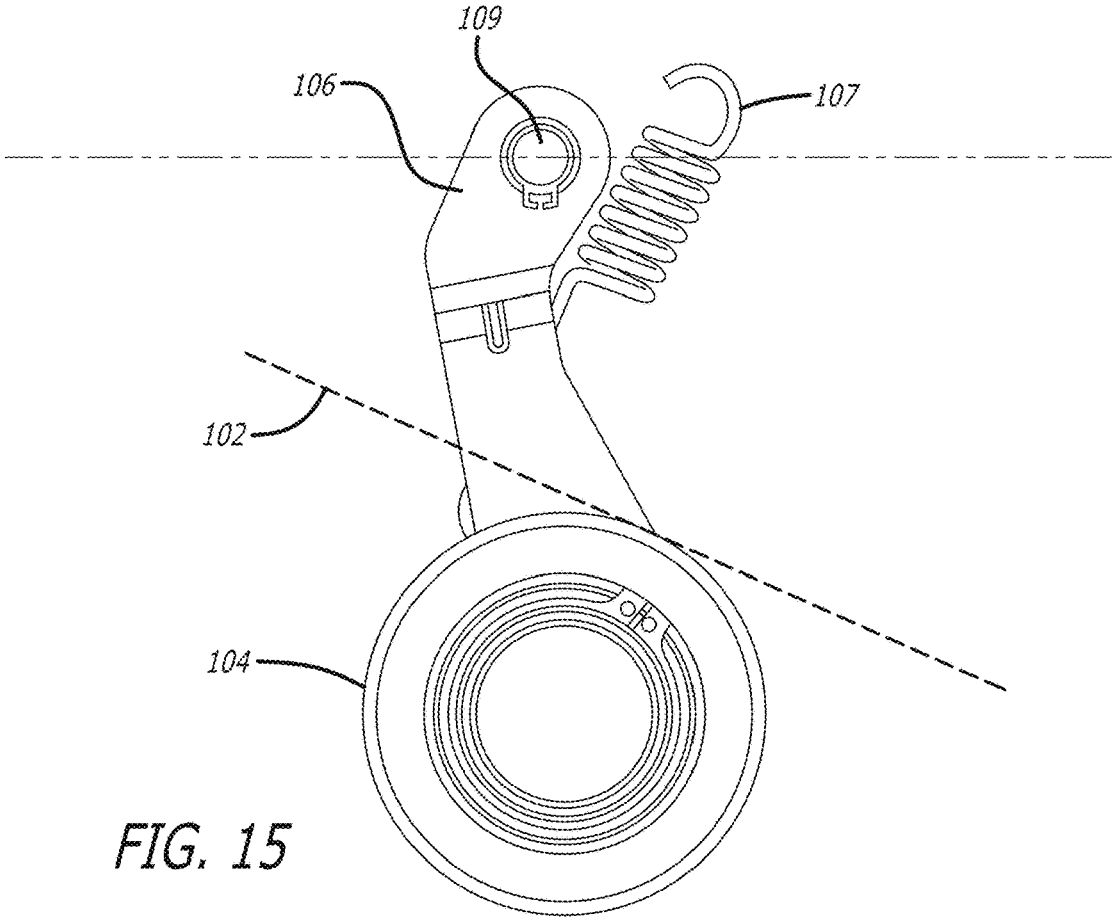
FIG. 15 is a side view of a chain tensioner system in an assembly state showing the pivot point.

Turning now to FIGS. 14 and 15, which are discussed simultaneously below. FIG. 14 is a side view of yet another alternative chain tensioner system in a working state showing the pivot point 109. FIG. 15 is a side view of a chain tensioner system in an assembly state showing the pivot point. The pivot point 109 may be seen in these two images above in the closed and open positions, respectively. The pivot point 109 has a dark line through it.

This configuration is simpler to install by having a single mount point and a single pivot point 109, but overall has the same function as the design described above with reference to FIG. 12. Because the pivot point 109 is between the two ends of the spring 107, the pulley arm 106 will prefer to be fully either in the open or the closed position and will resist being "in between" those two positions, as with the other configurations discussed above. The pulley arm 106 pushed upward causes the pulley 104 to engage with the chain 102 when in the closed position (FIG. 14). The pulley arm 106 pushed downward, past the overcenter position, cause the pulley 104 to disengage with the chain 102 and allow it to fall slack in the open position (FIG. 15).

FIGS. 16 and 17 are a top, front, perspective view and a top, back, perspective view of an alternative configuration of a chain tensioner system. Here, the mount point for the spring 107 closer to the pulley 104 (not visible) is protected from interference or accidental interaction with clothing or human skin by a curved portion 161 of the tensioner arm 108. The spring 107 is designed to engage directly with the frame of a bicycle, indoor cycle, or trainer, or, alternatively, to engage with the attachment point of FIG. 13. This alternative configuration causes a flat weld to join the pulley arm 106 and tensioner arm 108 which is less likely to break and more substantial than other attachment types discussed herein. Likewise, there is a single, combined pivot point which also can be used as the main point which joins to an attachment point (e.g. FIG. 13). This reduces the moving components and makes for still simpler manufacturing and installation. This design operates as shown in FIGS. 14-15.

Appendix A, incorporated herein by reference in its entirety, includes still more information regarding the specifics of the chain tensioner and its operation.

CLAUSES

Clause 1. A chain tensioner system comprising:
- a pulley for rotatably engaging a bicycle chain or belt;
- a pulley arm, upon which the pulley is mounted, the pulley arm movable between a closed position and an open position;
- a fixed tensioner arm, engaged with the pulley arm; and
- a tensioner element for connecting the fixed tensioner arm with the pulley arm, the tensioner element for keeping the pulley arm in either the closed position or the open position under tension provided by the tensioner element when the pulley arm is in either the closed position or the open position.

Clause 2. A chain tensioner system comprising:
- a fixed tensioner arm;
- a pulley for rotatably engaging a bicycle chain or belt;
- a pulley arm, upon which the pulley is mounted, the pulley arm being rotatably mounted on the fixed tensioner arm at a pivot point and being pivotable in a first plane and about the pivot, point between a closed position and an open position; and
- a tensioner element having a first end for connecting to the fixed tensioner arm at a first connecting point and a second end for connecting to the pulley arm at a second connecting point, thereby connecting the fixed tensioner arm with the pulley arm,
- wherein when the pulley arm is pivoted in a position where projections in the first plane of the first connecting point, the second connecting point and the pivot point are aligned, the projection of the pivot point is strictly between the projections of the first and second connecting points.

Clause 2. The chain tensioner system of any preceding clause further comprising a bicycle frame to which the fixed tensioner arm is mounted, wherein the bicycle frame is optionally combined with handlebars, a saddle, a crank, and pedals to form a bicycle.

Clause 4. The chain tensioner system of any preceding clause further comprising an indoor bicycle designed for exercise use indoors.

Clause 5. The chain tensioner system of any preceding clause wherein the tensioner element is a spring.

Clause 6. The chain tensioner system of any preceding clause wherein:
- the tensioner element is mounted to the fixed tensioner arm along at a tensioner mount point behind a pulley arm pivot point and to the pulley arm at a pulley arm mount point in front of the pulley arm pivot point; and the tensioner element can move freely past the pulley arm mount point such that the pulley arm is maintained by tension in the tensioner element on the pulley arm in the closed position or the open position because the tensioner element must be further stretched to move past the pulley arm pivot point.

The pulley arm mount point of Clause 6 may for example be the pivot point of Clause 2. The tensioner mount point of Clause 6 may be one of the first and second connecting point of Clause 2 and the pulley arm mount point may be the other of the first and second connecting point of Clause 2.

Clause 7. The chain tensioner system of clause 6 wherein the tensioner arm is made up of two sub-arms, the sub-arms forming a semi-rectangle to which the tensioner element is mounted at the tensioner mount point behind the pulley arm pivot point as the tensioner element is stretched and the pulley arm is moved from the closed position to the open position.

Clause 8. The chain tensioner of any preceding clause wherein when the pulley arm is in the closed position, the pulley is positioned to engage with the bicycle chain or belt to provide tension in the bicycle chain and belt so as to maintain the bicycle chain or belt in engagement with a crank and a gear.

Clause 9. The chain tensioner of any preceding clause wherein when the pulley arm is in the open position, the pulley releases engagement with the bicycle chain or belt to release tension in the bicycle chain and belt so as to end the bicycle chain or belt engagement with a crank and a gear.

Clause 10. A chain tensioner system comprising:

a pulley for rotatably engaging a bicycle chain or belt;

a pulley arm having a pulley arm end upon which the pulley is mounted and having a pulley arm pivot point, opposite the pulley arm end;

a tensioner element engaged with the pulley arm at a tensioner element pulley engagement point between the pulley arm end and the pulley arm pivot point and engaged with a tensioner element fixed point furthest from the pulley arm end in a direction beyond the pulley arm pivot point; and wherein as the pulley arm moves away from an open position towards a closed position, tension on the tensioner element is increased, as the pulley arm moves away from an closed position towards an open position, tension on the tensioner element is increased such that the pulley arm remains in one of the open or the closed position unless acted upon by an outside force.

Clause 11. The chain tensioner system of clause 10 wherein the tensioner element is a spring.

Clause 12. The chain tensioner system of clause 10 or 11 further comprising a bicycle frame to which the pulley arm is fixed at the pulley arm pivot point.

Clause 13. The chain tensioner system of clause 12 wherein the tensioner element fixed point is on or within the bicycle frame at a point furthest from the pulley arm end in the direction beyond the pulley arm pivot point.

Clause 14. The chain tensioner system of any one of clauses 10 to 13 further comprising a bicycle including a bicycle frame, a saddle, handlebars, the bicycle chain or belt, a crank, and pedals, wherein the pulley arm is fixed to the bicycle frame.

Clause 15. The chain tensioner system of any one of clauses 10 to 14 wherein when the pulley arm is in the closed position, the pulley engages with the bicycle chain or belt to provide tension in the bicycle chain and belt so as to maintain the bicycle chain or belt in engagement with the crank and a gear.

Clause 16. The chain tensioner system of any one of clauses 10 to 15 wherein when the pulley arm is in the open position, the pulley releases engagement with the bicycle chain or belt to release tension in the bicycle chain and belt so as to end the bicycle chain or belt engagement with the crank and a gear.

Clause 17. A bicycle system comprising:

a bicycle frame including attachment points for a crank and pedals and a rotatable element that may be moved by a bicycle chain or belt used with the crank and the pedals by a rider;

a pulley for rotatably engaging the bicycle chain or belt to provide tension to the bicycle chain or belt when in a closed position to ensure engagement of the bicycle chain or belt with the rotatable element and the crank and the pedals and to release that tension when in an open position;

a pulley arm having a pulley arm end upon which the pulley is mounted and having a pulley arm pivot point, opposite the pulley arm end;

a tensioner element engaged with the pulley arm at a tensioner element pulley engagement point between the pulley arm end and the pulley arm pivot point and engaged with a tensioner element fixed point on the bicycle frame furthest from the pulley arm end in a direction beyond the pulley arm pivot point; and wherein as the pulley arm moves from an open position to a closed position, tension on the tensioner element is increased and when the pulley arm is in the open position or the closed position, tension on the tensioner element is reduced such that the pulley arm remains in one of the open or the closed position unless acted upon by an outside force.

Clause 18. The bicycle system of clause 17 wherein the tensioner element is a spring.

Clause 19. The bicycle system of clause 17 or 18 wherein the tensioner element fixed point is on or within the bicycle frame at a point furthest from the pulley arm end in the direction beyond the pulley arm pivot point.

Clause 20. The bicycle system of any one of clauses 17 to 19 further comprising a saddle, handlebars, the bicycle chain or belt, the crank, and the pedals, wherein the pulley arm is fixed to the bicycle frame.

Clause 21. The bicycle system of any one of clauses 17 to 20 wherein when the pulley arm is in the closed position, the pulley engages with the bicycle chain or belt to provide tension in the bicycle chain and belt so as to maintain the bicycle chain or belt in engagement with the crank and a gear.

Clause 22. The bicycle system of any one of clauses 17 to 21 wherein when the pulley arm is in the open position, the pulley releases engagement with the bicycle chain or belt to release tension in the bicycle chain and belt so as to end the bicycle chain or belt engagement with the crank and a gear.

Clause 23. An exercise system comprising a rotatable element that may be moved by operation of a user, wherein the rotatable element is engaged with a chain or belt and wherein rotation of the rotatable element causes the chain or belt to travel;

a chain tensioner system of any of Clauses 1 to 16, wherein when in closed position, the chain tensioner increases tension in the chain or belt thereby increasing the friction between the chain or belt and the rotatable element.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A chain tensioner system comprising:

a pulley for rotatably engaging a bicycle chain or belt;

a pulley arm, upon which the pulley is mounted, the pulley arm movable between a closed position and an open position;

a fixed tensioner arm, engaged with the pulley arm; and a tensioner element for connecting the fixed tensioner arm with the pulley arm, the tensioner element for keeping the pulley arm in either the closed position or the open position under tension provided by the tensioner element when the pulley arm is in either the closed position or the open position.

2. The chain tensioner system of claim 1 further comprising a bicycle frame to which the fixed tensioner arm is mounted.

3. The chain tensioner system of claim 2 wherein the bicycle frame is combined with handlebars, a saddle, a crank, and pedals to form a bicycle.

4. The chain tensioner system of claim 1 further comprising an indoor bicycle designed for exercise use indoors.

5. The chain tensioner system of claim 1 wherein the tensioner element is a spring.

6. The chain tensioner system of claim 1 wherein:

the tensioner element is mounted to the fixed tensioner arm along at a tensioner mount point behind a pulley arm pivot point and to the pulley arm at a pulley arm mount point in front of the pulley arm pivot point; and the tensioner element can move freely past the pulley arm mount point such that the pulley arm is maintained by tension in the tensioner element on the pulley arm in the closed position or the open position because the tensioner element must be further stretched to move past the pulley arm pivot point.

7. The chain tensioner system of claim 6 wherein the tensioner arm is made up of two sub-arms, the sub-arms forming a semi-rectangle to which the tensioner element is mounted at the tensioner mount point behind the pulley arm pivot point as the tensioner element is stretched and the pulley arm is moved from the closed position to the open position.

8. The chain tensioner of claim 1 wherein when the pulley arm is in the closed position, the pulley engages with the bicycle chain or belt to provide tension in the bicycle chain and belt so as to maintain the bicycle chain or belt in engagement with a crank and a gear.

9. The chain tensioner of claim 1 wherein when the pulley arm is in the open position, the pulley releases engagement with the bicycle chain or belt to release tension in the bicycle chain and belt so as to end the bicycle chain or belt engagement with a crank and a gear.

10. A chain tensioner system comprising:

a pulley for rotatably engaging a bicycle chain or belt;

a pulley arm having a pulley arm end upon which the pulley is mounted and having a pulley arm pivot point, opposite the pulley arm end;

a tensioner element engaged with the pulley arm at a tensioner element pulley engagement point between the pulley arm end and the pulley arm pivot point and engaged with a tensioner element fixed point furthest from the pulley arm end in a direction beyond the pulley arm pivot point; and wherein as the pulley arm moves away from an open position towards a closed position, tension on the tensioner element is increased, as the pulley arm moves away from an closed position towards an open position, tension on the tensioner element is increased and when the pulley arm is in the open position or the closed position, tension on the tensioner element is reduced such that the pulley arm remains in one of the open or the closed position unless acted upon by an outside force.

11. The chain tensioner system of claim 10 wherein the tensioner element is a spring.

12. The chain tensioner system of claim 10 further comprising a bicycle frame to which the pulley arm is fixed at the pulley arm pivot point.

13. The chain tensioner system of claim 12 wherein the tensioner element fixed point is on or within the bicycle frame at a point furthest from the pulley arm end in the direction beyond the pulley arm pivot point.

14. The chain tensioner system of claim 10 further comprising a bicycle including a bicycle frame, a saddle, handlebars, the bicycle chain or belt, a crank, and pedals, wherein the pulley arm is fixed to the bicycle frame.

15. The chain tensioner system of claim 10 wherein when the pulley arm is in the closed position, the pulley engages with the bicycle chain or belt to provide tension in the bicycle chain and belt so as to maintain the bicycle chain or belt in engagement with the crank and a gear.

16. The chain tensioner system of claim 10 wherein when the pulley arm is in the open position, the pulley releases engagement with the bicycle chain or belt to release tension in the bicycle chain and belt so as to end the bicycle chain or belt engagement with the crank and a gear.

17. A bicycle system comprising:

a bicycle frame including attachment points for a crank and pedals and a rotatable element that may be moved by a bicycle chain or belt used with the crank and the pedals by a rider;

a pulley for rotatably engaging the bicycle chain or belt to provide tension to the bicycle chain or belt when in a closed position to ensure engagement of the bicycle chain or belt with the rotatable element and the crank and the pedals and to release that tension when in an open position;

a pulley arm having a pulley arm end upon which the pulley is mounted and having a pulley arm pivot point, opposite the pulley arm end;

a tensioner element engaged with the pulley arm at a tensioner element pulley engagement point between the pulley arm end and the pulley arm pivot point and engaged with a tensioner element fixed point on the bicycle frame furthest from the pulley arm end in a direction beyond the pulley arm pivot point; and wherein as the pulley arm moves from an open position to a closed position, tension on the tensioner element is increased and when the pulley arm is in the open position or the closed position, tension on the tensioner element is reduced such that the pulley arm remains in one of the open or the closed position unless acted upon by an outside force.

18. The bicycle system of claim 17 wherein the tensioner element is a spring.

19. The bicycle system of claim 17 wherein the tensioner element fixed point is on or within the bicycle frame at a point furthest from the pulley arm end in the direction beyond the pulley arm pivot point.

20. The bicycle system of claim 17 further comprising a saddle, handlebars, the bicycle chain or belt, the crank, and the pedals, wherein the pulley arm is fixed to the bicycle frame.

21. The bicycle system of claim 17 wherein when the pulley arm is in the closed position, the pulley engages with the bicycle chain or belt to provide tension in the bicycle chain and belt so as to maintain the bicycle chain or belt in engagement with the crank and a gear.

22. The bicycle system of claim 17 wherein when the pulley arm is in the open position, the pulley releases engagement with the bicycle chain or belt to release tension in the bicycle chain and belt so as to end the bicycle chain or belt engagement with the crank and a gear.

* * * * *